US007988427B2

(12) United States Patent
Patrick

(10) Patent No.: US 7,988,427 B2
(45) Date of Patent: Aug. 2, 2011

(54) COMPRESSOR MUFFLER

(75) Inventor: William P. Patrick, Glastonbury, CT (US)

(73) Assignee: Carrier Corporation, Farmington, CT (US)

( * ) Notice: Subject to any disclaimer, the term of this patent is extended or adjusted under 35 U.S.C. 154(b) by 480 days.

(21) Appl. No.: 11/816,669

(22) PCT Filed: Oct. 26, 2005

(86) PCT No.: PCT/US2005/038881

§ 371 (c)(1),
(2), (4) Date: Aug. 20, 2007

(87) PCT Pub. No.: WO2006/110180

PCT Pub. Date: Oct. 19, 2006

(65) Prior Publication Data

US 2008/0257640 A1 Oct. 23, 2008

Related U.S. Application Data

(60) Provisional application No. 60/670,499, filed on Apr. 11, 2005.

(51) Int. Cl.
*F04B 39/00* (2006.01)

(52) U.S. Cl. ..... 417/312; 181/256; 181/403

(58) Field of Classification Search ..... 417/312, 417/403; 181/228, 230, 256, 252, 403
See application file for complete search history.

(56) References Cited

U.S. PATENT DOCUMENTS

| | | | | |
|---|---|---|---|---|
| 3,726,359 | A * | 4/1973 | Dierl et al. | 181/224 |
| 3,874,828 | A | 4/1975 | Herschler et al. | |
| 4,147,475 | A | 4/1979 | Shoop et al. | |
| 4,957,517 | A | 9/1990 | Linnert | |
| 5,399,817 | A * | 3/1995 | Berges et al. | 181/228 |
| 5,705,777 | A | 1/1998 | Flanigan et al. | |
| 6,082,488 | A * | 7/2000 | Lin | 181/256 |
| 6,799,657 | B2 | 10/2004 | Daniels | |
| 6,840,746 | B2 | 1/2005 | Marshall et al. | |
| 7,100,737 | B2 | 9/2006 | Sishtla | |
| 2004/0065504 | A1 * | 4/2004 | Daniels | 181/252 |
| 2005/0023077 | A1 * | 2/2005 | Sishtla | 181/252 |
| 2005/0023940 | A1 * | 2/2005 | Van Beusekom | 312/138.1 |
| 2009/0068028 | A1 * | 3/2009 | Sishtla | 417/312 |

FOREIGN PATENT DOCUMENTS

| | | |
|---|---|---|
| CN | 2147356 Y | 11/1993 |
| JP | 2704039 B2 | 10/1997 |

OTHER PUBLICATIONS

Chinese Office Action for CN200580049445.8, dated Dec. 12, 2008.

European Search Report for European Patent Application No. 05819633.8, dated Jun. 9, 2011.

* cited by examiner

*Primary Examiner* — Charles G Freay

*Assistant Examiner* — Todd D Jacobs

(74) *Attorney, Agent, or Firm* — Bachman & LaPointe, P.C.

(57) ABSTRACT

A compressor has first (26) and second (28; 30) enmeshed rotors rotating about first (500) and second (502; 504) axes to pump refrigerant to a discharge plenum (42). The compressor includes a muffler system (200) comprising a sound absorbing first element (232) and a sound absorbing second element (236). The second element at least partially surrounds the first element and defines a generally annular flow path portion (230) between the first element and the second element. A wall (250) at least partially surrounds the second element. A space (259) optionally containing a sound absorbing third element (261) surrounds the wall.

13 Claims, 4 Drawing Sheets

COMPRESSOR MUFFLER

CROSS-REFERENCE TO RELATED APPLICATION

Benefit is claimed of U.S. patent application Ser. No. 60/670,499, filed Apr. 11, 2005, and entitled "Compressor Muffler", the disclosure of which is incorporated by reference herein as if set forth at length.

BACKGROUND OF THE INVENTION

The invention relates to compressors. More particularly, the invention relates to sound and vibration suppression in screw-type compressors.

In positive displacement compressors, discrete volumes of gas are: trapped at a suction pressure; compressed; and discharged at a discharge pressure. The trapping and discharge each may produce pressure pulsations and related noise generation. Accordingly, a well developed field exists in compressor sound suppression.

One class of absorptive mufflers involves passing the refrigerant flow discharged from the compressor working elements through an annular space between inner and outer annular layers of sound-absorptive material (e.g., fiber batting). US Patent Application Pub. No. 2004/0065504 A1 discloses a basic such muffler and then improved versions having integral Helmholtz resonators formed within the inner layer. The disclosure of this '504 publication is incorporated by reference herein as if set forth at length.

International Applications PCT/US04/34946 and PCT/US05/03403 disclose further muffler configurations. Exemplary embodiments of these mufflers use inner and outer stacked rings of sound absorbing material. Exemplary ring material is expanded polypropylene beads (e.g., material known as porous expanded polypropylene (PEPP)). The disclosures of these applications are incorporated by reference herein as if set forth at length.

SUMMARY OF THE INVENTION

Accordingly, one aspect of the invention involves a compressor having first and second enmeshed rotors rotating about first and second axes to pump refrigerant to a discharge plenum. The compressor includes a muffler system comprising a sound absorbing first element and a sound absorbing second element. The second element at least partially surrounds the first element and defines a generally annular flow path portion between the first element and the second element. A wall at least partially surrounds the second element. A sound-absorbing third element at least partially surrounds the wall within a muffler case.

In various implementations, the wall may be essentially imperforate. The wall may have a thickness in excess of 0.5 cm. The thickness may be 0.8-1.2 cm. The wall may consist essentially of steel. The case may consist essentially of steel or cast iron. At least one of the first, second, and third elements may comprise a number of rings of porous expanded polypropylene. Along majorities of total longitudinal spans of the first and second elements, the first and second elements may have inboard and outboard surfaces that are essentially non-convergent and non-divergent. At least one foraminate metallic element may be between the first and second elements. A first such foraminate metallic element may be at an inboard boundary of the generally annular flowpath portion and a second may be at an outboard boundary. The third element may have a median thickness of 0.5-2.0 cm (more narrowly 1.0-1.5 cm). The second element may have a median thickness of 3.0-8.0 cm (more narrowly 4.0-6.0 cm).

Such a muffler may be provided in a remanufacturing of an existing compressor or a reengineering of an existing configuration of the compressor. The initial/baseline compressor or configuration may lack at least one of the wall and the third element.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
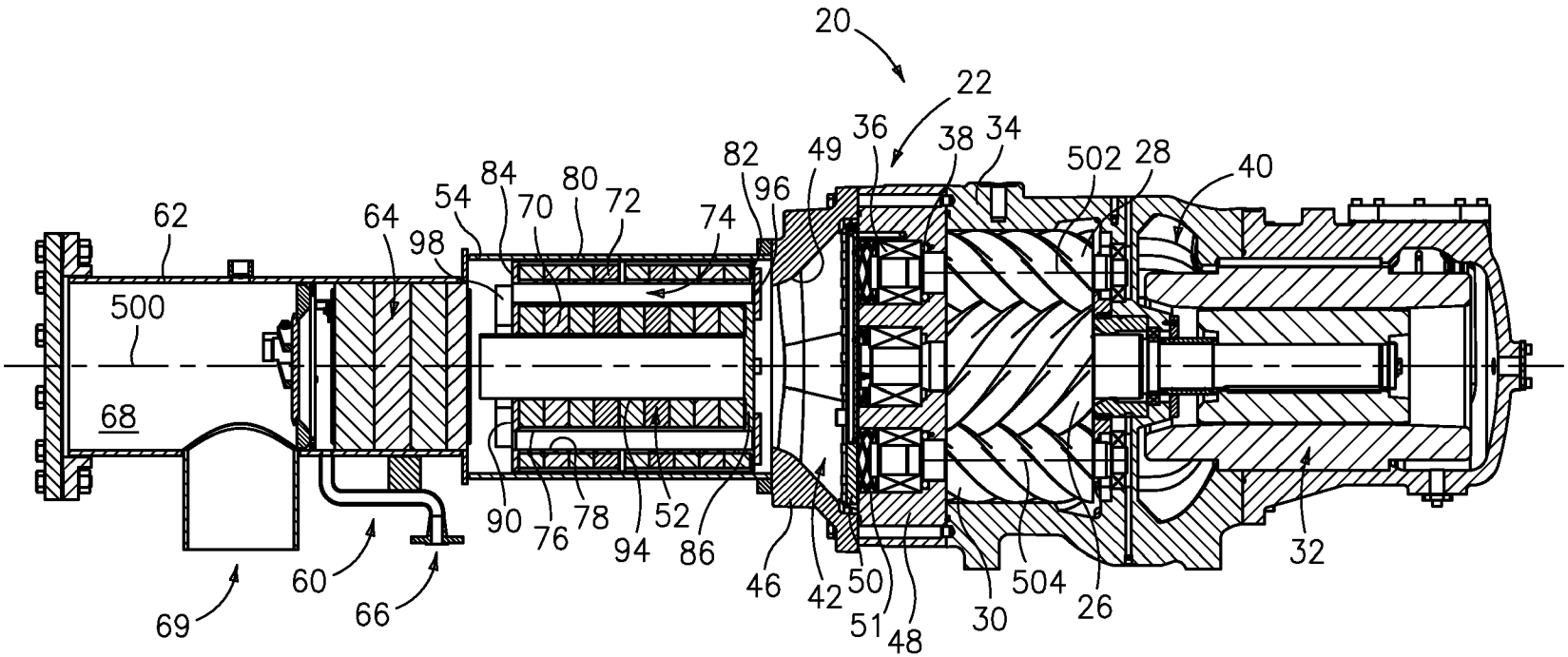
FIG. 1 Prior Art
FIG. 1 is a longitudinal sectional view of a compressor.

FIG. 1 shows a compressor 20 as in PCT/US05/03403 having a housing or case assembly 22. The exemplary compressor is a three-rotor, screw-type, hermetic compressor having rotors 26, 28, and 30 with respective central longitudinal axes 500, 502, and 504. In the exemplary embodiment, the first rotor 26 is a male-lobed rotor driven by a coaxial electric motor 32 and, in turn, enmeshed with and driving the female-lobed rotors 28 and 30. In the exemplary embodiment, the male rotor axis 500 also forms a central longitudinal axis of the compressor 20 as a whole. The rotor working portions are located within a rotor case segment 34 of the case assembly 22 and may be supported by bearings 36 and sealed by seals 38 engaging rotor shafts at each end of the associated rotor working portion. When driven by the motor 32, the rotors pump and compress a working fluid (e.g., a refrigerant) along a flowpath from a suction plenum 40 to a discharge plenum 42. The flowpath is divided along distinct compression pockets or compression paths defined by associated pairs of the rotors between the suction and discharge plenums. Thus, the flow splits in the suction plenum and merges in the discharge plenum.

In the exemplary embodiment, the suction plenum 40 is located within an upstream end of the rotor case 34 and the discharge plenum is located generally within a discharge case 46 separated from the rotor case by a bearing case 48 and having a generally downstream-convergent interior surface 49. In the exemplary embodiment, a bearing cover/retainer plate 50 is mounted to a downstream end of the bearing case 48 to retain the bearing stacks. Downstream of the discharge case 46 is a muffler 52 in a muffler case 54. Downstream of the muffler 52 is an oil separator unit 60 having a case 62 containing a separator mesh 64. An oil return conduit 66 extends from the housing 62 to return oil stopped by the mesh 64 to a lubrication system (not shown). An outlet plenum 68 having an outlet port 69 is downstream of the mesh 64.

The exemplary main muffler 52 includes annular inner and outer elements 70 and 72 separated by a generally annular space 74. These elements may be formed of sound absorption material. In the exemplary embodiment, the inner element 70 is retained and separated from the space 74 by an inner foraminate sleeve 76 (e.g., wire mesh or perforated/expanded metal sheeting) and the outer element 72 is similarly separated and retained by an outer foraminate sleeve 78. In the exemplary embodiment, the outer element 72 is encased within an outer sleeve 80 telescopically received within the housing 54. The sleeves 80 and 78 are joined at upstream and downstream ends by annular plates 82 and 84. In the exemplary embodiment, the upstream end of the sleeve 76 is closed by a circular plate 86 and the downstream end closed by an annular plate 90. In the exemplary embodiment, a non-foraminate central core 94 (e.g., steel pipe) extends through the inner element 70 and protrudes beyond a downstream end thereof. At the upstream end of the main muffler, radially-extending connectors 96 join the circular plate 86 to the annular plate 82. At the downstream end, radially-extending connectors 98 connect the annular plates 84 and 90 to hold the inner and outer elements concentrically spaced apart to maintain the annular space 74.

In operation, compressed gas flow exits the compression pockets of the screw rotors 26, 28, 30 and flows into the discharge plenum 42. Upon exiting the compressor discharge plenum, the gas flows down the annular space 74. Upon exiting the muffler, the gas flow, which typically has entrained oil droplets, flows through the oil separating mesh 64. The mesh 64 captures any oil entrained in the gas and returns it to the oil management system by means of the conduit 66. The gas leaves the oil separating mesh and enters the plenum 68 and exits the outlet 69 toward the condenser (not shown).

Figure 2:
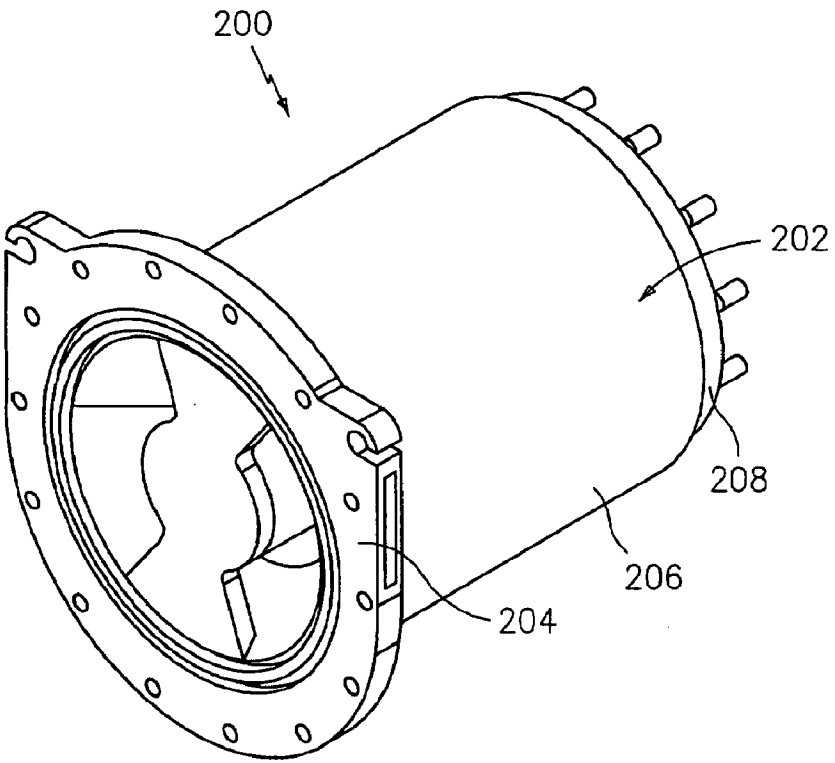
FIG. 2 is a view of a case and muffler assembly for installation on the compressor of FIG. 1.

It may be desirable to further limit the sound transmitted by the muffler case. One method is to thicken the muffler case. PCT/US04/34946 shows a relatively thick combined discharge and muffler case. Yet further sound limitation may be desired. According to the present invention further means are used to isolate the muffler case from the refrigerant flow. FIG. 2 shows an improved case and muffler assembly 200. The assembly 200 uses a case 202 that serves as a combined muffler case and discharge case (e.g., as in PCT/US04/34946), although muffler case-only implementations are also possible.

Figure 4:
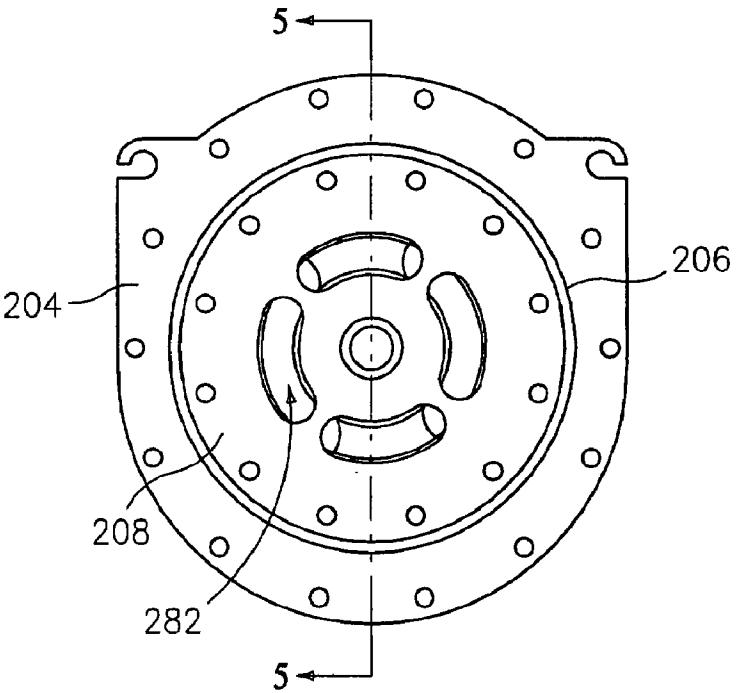
FIG. 4 is a downstream end view of the assembly of FIG. 2.
Figure 3:
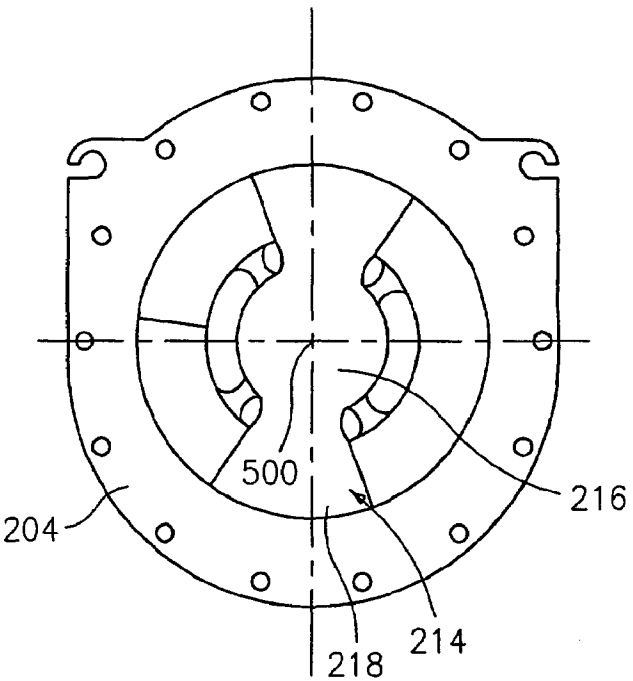
FIG. 3 is an upstream end view of the assembly of FIG. 2.

The exemplary case 202 has an upstream mounting flange. 204 (also in FIG. 3) for bolting to the bearing case. A generally circular cylindrical body or sidewall 206 is welded to and extends downstream from the flange 204. A downstream end plate 208 (also in FIG. 4) is welded to a downstream end of the body 206. A periphery of the end plate includes an array of threaded holes for bolting to an upstream flange of the separator case/housing 62.

Figure 6:
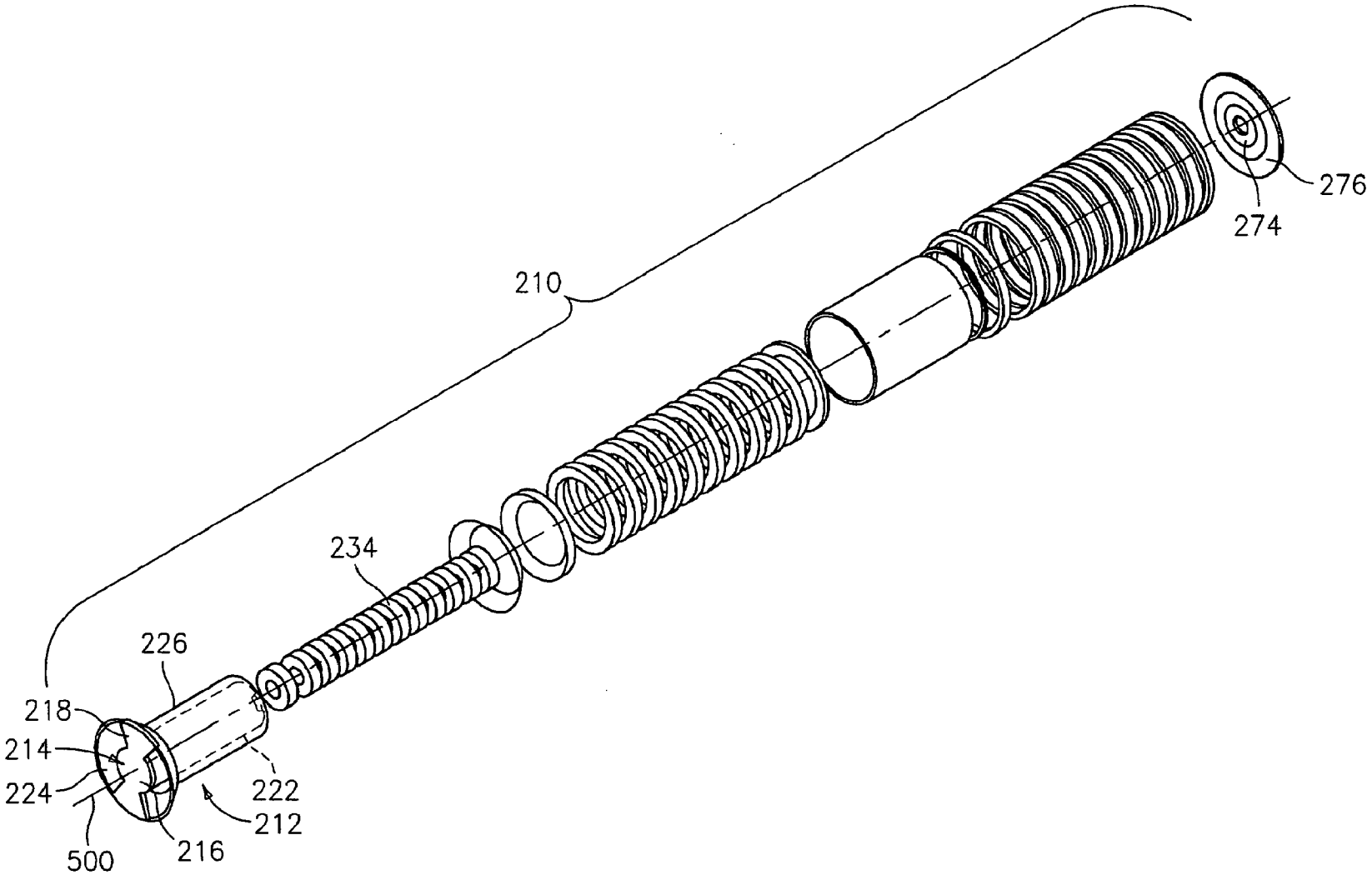
FIG. 6 is a partially exploded view of the muffler of FIG. 5.

A muffler unit 210 (FIG. 6) may be installed to the case 202 through the open upstream end of the body 206. A structural core assembly 212 of the muffler includes an upstream metal end member 214. The exemplary member 214 is approximately bat- or butterfly-shaped, having a central hub area 216 positioned to cover the male rotor bearing compartment and two wings 218 positioned to cover the female rotor bearing compartments while leaving the discharge ports open.

Figure 5:
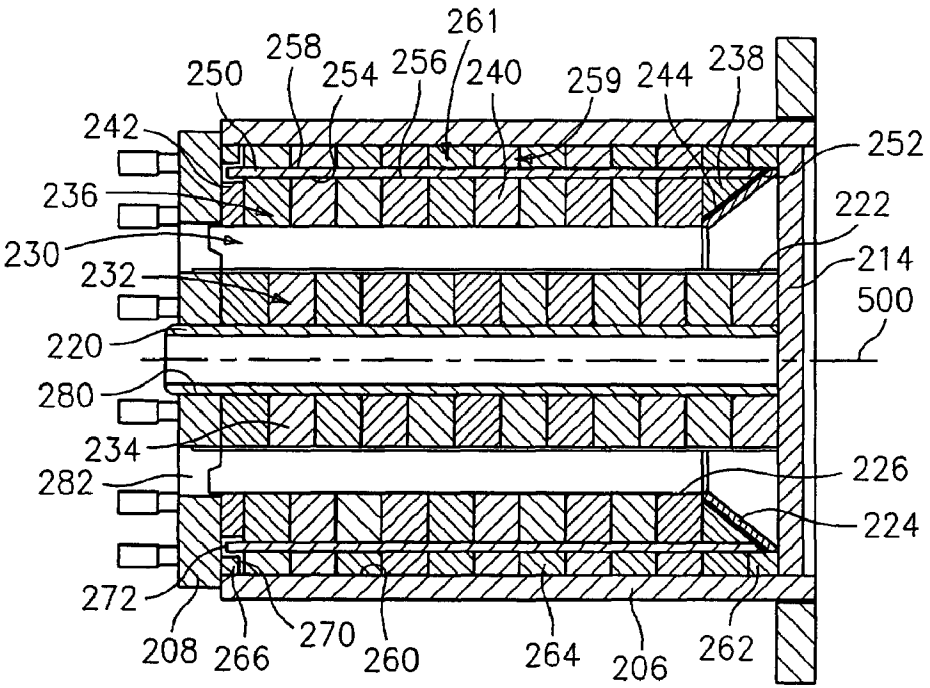
FIG. 5 is a longitudinal sectional view of the muffler of the assembly of FIG. 2.

FIG. 5 shows a central core pipe 220 having an upstream end welded to a downstream face of the member 214. A foraminate centerbody sleeve 222 (e.g., metallic mesh or perforated sheet metal) has an upstream end welded to a downstream face of the member 214 at the periphery of the hub 216. A metal frustoconical discharge plenum wall member 224 has a large upstream end welded to a downstream face of the member 214 slightly inboard of the wing periphery. A foraminate outer element liner 226 (e.g., metallic mesh or perforated sheet metal) has an upstream end welded to a small downstream end of the wall member 224.

An annular flow passageway 230 is defined between the liner 226 and the sleeve 222. To form the inner element 232, a stack of PEPP rings 234 is received in the annular space between the pipe 220 and sleeve 222. To form the outer element 236, a stack of PEPP rings 238, 240, and 242 is accommodated over the liner 226. The upstream ring 238 has a frustoconical upstream surface for engaging a downstream surface of the member 224 via a neoprene seal 244. A plurality of rectangular sectioned rings 240 follow to a downstreammost ring 242.

An additional annular wall 250 may be placed over the outer element rings 238, 240, and 242. The exemplary wall 250 is a continuous, imperforate metallic (e.g., steel) tube/pipe intended to acoustically float relative to the case 202 (e.g., not being rigidly structurally connected to the case 202. The exemplary floating is accommodated by allowing the upstream end 252 to rest against the seal 244. An inboard surface 254 rests against the outer surface 256 of the outer muffler element. In the exemplary embodiment, the upstream end 252 is beveled to minimize contact pressure against the downstream surface of the seal 244.

The annular space 259 between the wall outboard surface 258 and the inboard surface 260 of the body may be filled by further sound-absorbing material 261 such as a stack of PEPP rings 262, 264, and 266. The upstreammost ring 262 may be rebated to accommodate the wings 218. An isolation seal 270 may engage the downstream rim area 272 of the wall 250 and may have a portion extending outward between the downstreammost ring 266 and a downstreammost one of the rings 264 to prevent infiltration of refrigerant pulsations into the space 259. Thermal isolation gaskets 274 and 276 (FIG. 6) are inserted between the downstream ends of the inner and outer polypropylene rings, respectively, and the end plate 208 to protect the polypropylene material from heat caused by welding operations during final muffler assembly.

When assembled, the muffler may be inserted into the case 202. When fully inserted, an end portion of the pipe 220 is received in a central aperture 280 in the end plate 208. The end plate further includes outlet apertures 282 aligned with the passageway to pass the refrigerant to the separator.

The combined effect of the case sidewall 206 and the floating wall 250 is greater sound reduction than a single wall of the same mass or combined thickness (although not necessarily greater than a much more massive wall—e.g., whose thickness equals the combined wall thickness plus the thickness of the space 259). The particular relative dimensions may be engineered to provide maximal or other desired degree of sound/vibration suppression at one or more frequencies (e.g., the frequencies of compression pocket opening/closing at nominal operating speed or a range thereof).

The floating wall may operate to keep noise from reaching the outer case and then propagating downstream through piping to the condenser (not shown, which may act as an acoustical radiator). Sound propagating radially outward through the outer element 236 is deflected by the floating wall 250 back toward the center of the muffler where it can be further attenuated.

In the absence of the floating wall 250, the sound would travel directly to the outer muffler case 54. The sound would then either radiate into the room or travel downstream along the housing and discharge the pipe (not shown) to the condenser (not shown) and then radiate into the room.

In alternative embodiments, the floating wall can be of a non-steel or non-metal heavy/dense material which can exist in a refrigerant environment. The floating wall may have multiple layers (e.g., as multiple floating walls). Other materials may be used for the inner, outer and exterior elements (e.g., glass fiber batting).

The inventive system may be implemented in a remanufacturing of a given compressor system or a reengineering of a configuration thereof. One area of possibilities involve preserving an existing case. This may involve a new muffler whose annular flow space is shifted inward to provide room for the floating wall. Another area involves preserving an existing basic muffler element while expanding the case to accommodate the floating wall. In the reengineering of a baseline system having a thick-walled case, the case could be thinned with the floating wall making up for the thinning (e.g., to maintain or reduce an overall weight while not adversely affecting noise control).

One or more embodiments of the present invention have been described. Nevertheless, it will be understood that various modifications may be made without departing from the spirit and scope of the invention. For example, in a reengineering or remanufacturing situation, details of the existing compressor may particularly influence or dictate details of the implementation. Accordingly, other embodiments are within the scope of the following claims.

What is claimed is:

1. A compressor comprising:

a first rotor (26) having a first rotational axis (500);

a second rotor (28; 30) having a second rotational axis (502; 504) and enmeshed with the first rotor;

a discharge plenum (42); and a muffler system (200) comprising:

a case (202);

a sound-absorbing first element (232);

a sound-absorbing second element (236) at least partially surrounding the first element and defining a generally annular flow path portion (230) between the first element and second element;

a wall (250) at least partially surrounding the second element; and a sound-absorbing third element (261) at least partially surrounding the wall within the case, the wall abutting the second element and third element and each of the first (232), second (236), and third (261) elements comprising a plurality of rings (234; 238, 240, 242; 262, 264, 266) of porous expanded polypropylene.

2. The compressor of claim 1 wherein:

the wall (250) is essentially imperforate.

3. The compressor of claim 1 wherein:

the wall (250) has a thickness in excess of 0.5 cm.

4. The compressor of claim 1 wherein:

the wall (250) has a thickness of 0.8-1.2 cm.

5. The compressor of claim 1 wherein:

the wall (250) consists essentially of steel.

6. The compressor of claim 1 wherein:

the case consists essentially of steel or cast iron.

7. The compressor of claim 1 wherein:

along a majority of a total longitudinal span of the first element (232), the first element has inboard and outboard surfaces that are essentially non-convergent and non-divergent; and along a majority of a total longitudinal span of the second element (236), the second element has inboard and outboard surfaces that are essentially non-convergent and non-divergent.

8. The compressor of claim 1 wherein:

the muffler system includes at least one foraminate metallic element (222, 226) between the first and second elements.

9. The compressor of claim 1 wherein:

a first foraminate metallic element (222) is at an inboard boundary of the generally annular flow path portion (230); and a second foraminate metallic element (226) is at an outboard boundary of the generally annular flow path portion (230).

10. The compressor of claim 1 wherein:

the third element (261) has a median thickness of 0.5-2.0 cm; and the second element (236) has a median thickness of 3.0-8.0 cm.

11. The compressor of claim 1 wherein:

the third element (261) has a median thickness of 1.0-1.5 cm; and the second element (236) has a median thickness of 4.0-6.0 cm.

12. The compressor of claim 1 wherein:

the first (232), second (236), and third (261) elements are non-metal.

13. The compressor of claim 12 wherein:

the wall (250) consists essentially of steel.

* * * * *